US008707519B2

(12) United States Patent
Elkasevic et al.

(10) Patent No.: US 8,707,519 B2
(45) Date of Patent: Apr. 29, 2014

(54) DOMESTIC APPLIANCE HINGE ASSEMBLY WITH UNIVERSAL HINGE BODY DESIGN

(75) Inventors: Suad Elkasevic, Winterville, NC (US); George May, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 13/478,281

(22) Filed: May 23, 2012

(65) Prior Publication Data

US 2013/0312222 A1 Nov. 28, 2013

(51) Int. Cl.
*E05F 1/08* (2006.01)

(52) U.S. Cl.
USPC ..... 16/286

(58) Field of Classification Search
USPC ..... 16/286, 287, 257, 260, 261, 263, 323, 16/324; 126/191, 192, 194; 49/386, 389
See application file for complete search history.

(56) References Cited

U.S. PATENT DOCUMENTS

| | | | | |
|---|---|---|---|---|
| 2,833,270 | A * | 5/1958 | Brown et al. | 126/191 |
| 3,150,658 | A * | 9/1964 | Ferland | 126/191 |
| 4,639,971 | A * | 2/1987 | Kurtz | 16/247 |
| 6,035,848 | A * | 3/2000 | Ray et al. | 126/194 |
| 6,397,836 | B1 * | 6/2002 | Pelletier et al. | 126/194 |
| 6,453,510 | B1 * | 9/2002 | Cummins et al. | 16/343 |
| 6,719,383 | B2 | 4/2004 | Elick et al. | |
| 6,789,293 | B2 * | 9/2004 | Habegger et al. | 16/343 |
| 7,096,535 | B2 * | 8/2006 | Lin | 16/287 |
| 7,676,888 | B2 | 3/2010 | Vanini | |
| 2003/0056328 | A1 * | 3/2003 | Habegger et al. | 16/343 |
| 2003/0172920 | A1 * | 9/2003 | Gronbach | 126/197 |
| 2006/0032019 | A1 * | 2/2006 | Kistner et al. | 16/286 |
| 2007/0101542 | A1 * | 5/2007 | Lee | 16/286 |
| 2008/0168618 | A1 | 7/2008 | Hottmann | |
| 2008/0189906 | A1 * | 8/2008 | Resnik et al. | 16/54 |
| 2008/0295283 | A1 | 12/2008 | Tice | |
| 2010/0018240 | A1 | 1/2010 | Hecht et al. | |
| 2010/0051067 | A1 | 3/2010 | Dalsing | |
| 2010/0109497 | A1 | 5/2010 | Blersch et al. | |
| 2010/0127606 | A1 | 5/2010 | Collene | |
| 2010/0139169 | A1 | 6/2010 | Patil et al. | |
| 2010/0148646 | A1 | 6/2010 | Bettinzoli | |
| 2010/0281650 | A1 | 11/2010 | Kleemann et al. | |
| 2011/0017191 | A1 | 1/2011 | White et al. | |
| 2011/0068671 | A1 | 3/2011 | Vanini | |

FOREIGN PATENT DOCUMENTS

| | | | |
|---|---|---|---|
| EP | 748987 | A1 * | 12/1996 |
| EP | 1039231 | A2 * | 9/2000 |
| JP | 09078927 | A * | 3/1997 |

* cited by examiner

*Primary Examiner* — Chuck Mah
(74) *Attorney, Agent, or Firm* — James E. Howard; Andre Pallapies

(57) ABSTRACT

A hinge assembly is provided for pivotably attaching a door to a domestic appliance. The hinge assembly includes a hinge body having two mounting areas; a damper; a foot pivotably attached to the damper, the foot being configured to engage a foot receiving portion of the appliance body such that the hinge body and the door pivot relative to the appliance body; and a first mounting spacer attached to the hinge body at a first one of the mounting areas, the first mounting spacer being configured to attach to the door such that the hinge body is fixed relative to the door. Each of the two mounting areas is configured to receive a first fastener to attach the first mounting spacer to the hinge body, and each of the two mounting areas is configured to receive a second fastener to attach the door to the hinge body.

21 Claims, 3 Drawing Sheets

DOMESTIC APPLIANCE HINGE ASSEMBLY WITH UNIVERSAL HINGE BODY DESIGN

FIELD OF THE INVENTION

The invention is directed to a hinge assembly for a domestic appliance. The hinge assembly has a hinge body designed to be used in various different domestic appliances.

An example of an application for the invention is a hinge assembly used with a door of a domestic appliance.

BACKGROUND OF THE INVENTION

Many domestic appliances, such as built in ovens, have one or more doors that swing open about a horizontal axis such that the door swings downward into an open position. Such a door is often heavy and uses springs of significant strength to counteract a portion of the weight of the door so that it is easier for a user to open and close the door. These springs often act to slam the door into the closed position after the door has passed a particular rotational position when moved upward toward the closed position. This slamming is undesirable for at least the reasons that it can make a loud noise, it can damage the appliance over time, and it gives the appearance of low quality. The result of such slamming is usually that the user continues to hold the door until it has reached the closed position.

To prevent the undesirable slamming, soft-close hinges can be employed. Soft-close hinges often include some type of damper that slows the movement of the door for a predetermined distance before the door reaches the closed position. This damping prevents the slamming of the door and results in a much more desirable appliance.

SUMMARY

Some dampers include a spring mounted inside a cylinder. The spring is often very long compared to its diameter in order to fit inside the cylinder. The damper can include a rod that moves relative to the cylinder when the damper is operated. A hinge assembly can include a damper, a spring, a hinge body, and a hinge foot. Often a domestic appliance, an oven for example, is provided with one hinge assembly on each side of an opening which is covered by the door. The hinge foot can be provided with an engagement portion that engages a foot receiving portion on the body of the domestic appliance. Due to the spring and damper forces acting on the foot and the foot receiving portion, and the weight of the door, a strong mounting system for mounting the hinge assembly to the door is required. Also, a mounting system that enables the same hinge body to be used with different appliances is desirable.

The invention recognizes the existence of the above described advantages to having a universal hinge body design and addresses this by providing a mounting system that is adaptable to different appliances.

Particular embodiments of the invention are directed to a hinge assembly for pivotably attaching a door to a domestic appliance having an appliance body, The hinge assembly includes a hinge body having two mounting areas; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a foot pivotably attached to the damper, the foot being configured to engage a foot receiving portion of the appliance body such that the hinge body and the door pivot relative to the appliance body; and a first mounting spacer attached to the hinge body at a first one of the mounting areas, the first mounting spacer being configured to attach to the door such that the hinge body is fixed relative to the door. Each of the two mounting areas is configured to receive a first fastener to attach the first mounting spacer to the hinge body, and each of the two mounting areas is configured to receive a second fastener to attach the door to the hinge body.

Other embodiments of the invention are directed to a door assembly for pivotably attaching to a domestic appliance having an appliance body. The door assembly includes a door; and a hinge assembly. The hinge assembly includes a hinge body having two mounting areas; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a foot pivotably attached to the damper, the foot being configured to engage a foot receiving portion of the appliance body such that the hinge body and the door pivot relative to the appliance body; and a first mounting spacer attached to the hinge body at a first one of the mounting areas, the first mounting spacer being attached to the door such that the hinge body is fixed relative to the door. Each of the two mounting areas is configured to receive a first fastener to attach the first mounting spacer to the hinge body, and each of the two mounting areas is configured to receive a second fastener to attach the door to the hinge body.

Other embodiments of the invention are directed to an appliance that has an appliance body with a foot receiving portion; a door; and a hinge assembly. The hinge assembly includes a hinge body having two mounting areas; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of a coil of the coil spring, the damper damping the movement of the rod relative to the cylinder, and the rod extending along the central longitudinal axis of the damper; a foot pivotably attached to the damper, the foot engaging the foot receiving portion of the appliance body such that the hinge body and the door pivot relative to the appliance body; and a first mounting spacer attached to the hinge body at a first one of the mounting areas, the first mounting spacer being attached to the door such that the hinge body is fixed relative to the door. Each of the two mounting areas is configured to receive a first fastener to attach the first mounting spacer to the hinge body, and each of the two mounting areas is configured to receive a second fastener to attach the door to the hinge body.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Many domestic appliances, such as, for example, built-in ovens, have a door that pivots relative to the body of the appliance to permit access to an internal space of the appliance. These doors are often heavy due to glass view panels, insulation, ventilating structure, and other elements. Springs are often used to reduce the effort needed from the user to close the door. These springs can be strong in order to exert a force that counteracts a large portion of the weight of a heavy door. The result of strong springs is often a slamming of the door once the door passes a particular point in the pivoting.

One or more dampers can be used to damp the closing action resulting from the strong springs to eliminate the slamming that can be caused by undamped springs. The dampers can be any type of damper including, but not limited to, gas filled or liquid filled dampers. Examples of fluid (gas and/or liquid) filled dampers have a cylinder that contains the fluid and may or may not include one or more orifices through with the fluid moves to create the damping force.

Some door hinge assemblies include both a spring and a damper. Some of these door hinge assemblies place the spring inside the damper cylinder to provide a compact assembly.

Figure 1:
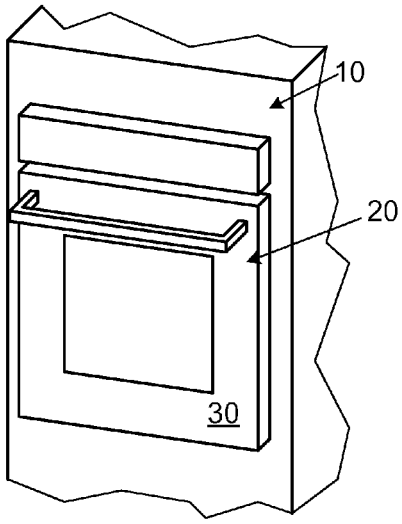
FIG. 1 is a perspective view of a domestic appliance in accordance with exemplary embodiments of the invention.

FIG. 1 shows an example of a domestic appliance 20 mounted in a cabinet 10. An example of a domestic appliance 20 is a cabinet-mounted oven. In this example, domestic appliance 20 includes a door 30 pivotably attached to a body of domestic appliance 20 to selectively open and close an interior space of domestic appliance 20. In some embodiments, door 30 is attached to the body of domestic appliance 20 by two hinge assemblies. Examples of the hinge assemblies are discussed below.

Figure 2:
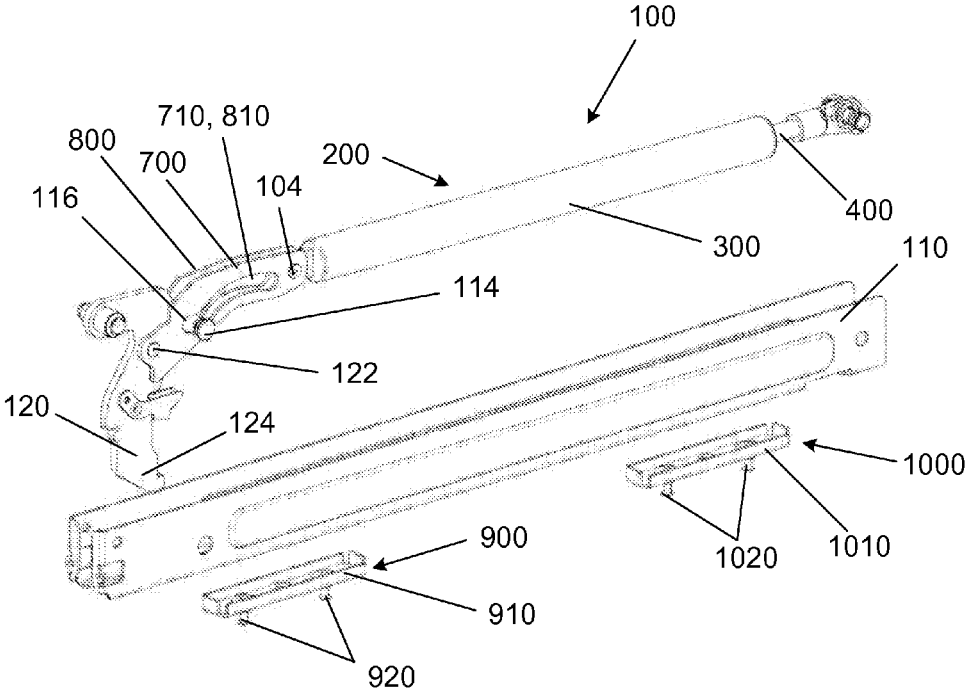
FIG. 2 is a partial exploded perspective view of a hinge assembly in accordance with exemplary embodiments of the invention.

FIG. 2 shows a hinge assembly 100 that can be used to pivotably attach door 30 to the body of domestic appliance 20. In particular embodiments, two hinge assemblies 100 are used, one on each side of the opening of the interior space of domestic appliance 20. A hinge assembly body 110 partially surrounds an assembly that includes a damper 200, a linkage 700, 800, and a foot 120.

Damper 200 includes a cylinder 300 and a rod 400. Rod 400 is partially inside cylinder 300 and partially outside cylinder 300 and moves in a reciprocating motion relative to cylinder 300. A damping force is applied to rod 400 as it moves relative to cylinder 300 and damps the motion of rod 400 relative to cylinder 300. This damping force can result from a fluid inside cylinder 300 being forced through at least one aperture when rod 400 moves, or from some other type of damping mechanism.

In this example, hinge assembly 100 is attached to door 30 such that hinge body 110 does not move relative to door 30. Mounting spacers 900, 1000 are provided to securely attach hinge body 110 to door 30. Mounting spacers 900, 1000 have body portions 910, 1010, respectively that are attached to hinge body 110 by fasteners 920, 1020, respectively. Fasteners 920, 1020, can be, for example, rivets or screws. As shown in FIG. 2, foot 120 is pivotably attached to damper 200 by a pin 122. An engagement end 124 of foot 120 engages a foot receiving feature (for example foot receiving portion 600 shown in FIG. 4) on domestic appliance 20 to attach door 30 to domestic appliance 20. Hinge assembly 100 and door 30 are then pivotable relative to the body of domestic appliance 20. Foot 120 is attached in this embodiment to the end of cylinder 300 by a first linkage member 700 and a second linkage member 800 such that foot 120 can pivot relative to cylinder 300. First and second linkage members 700, 800 are pivotably attached to cylinder 300 by a pin 104 and are pivotably attached to foot 120 by pin 122.

Figure 5:
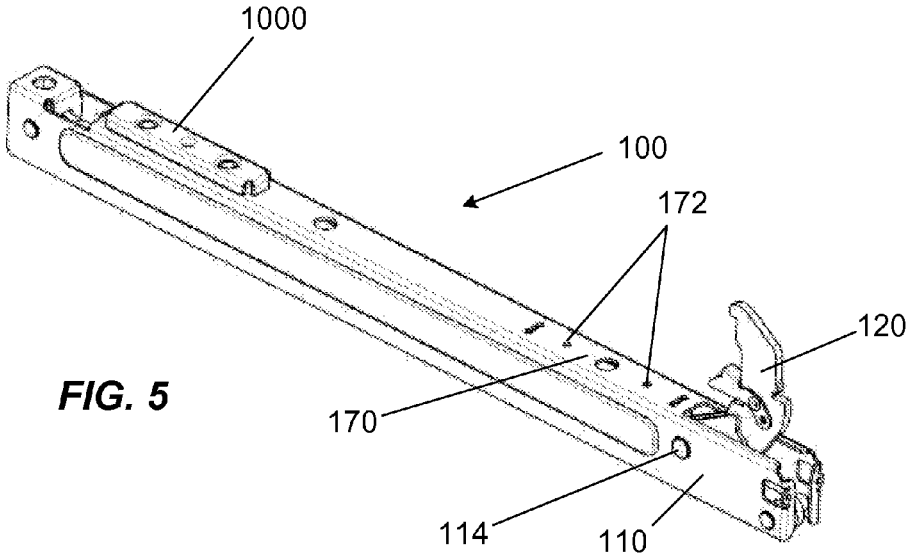
FIG. 5 is a perspective view of an exemplary embodiment of the invention in a first configuration.
Figure 6:
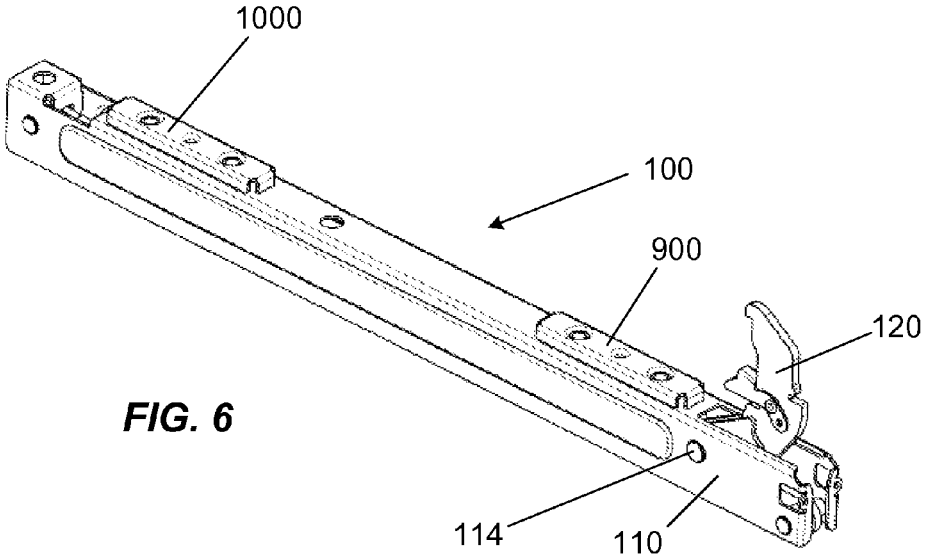
FIG. 6 is a perspective view of an exemplary embodiment of the invention in a second configuration.

First linkage member 700 and second linkage member 800 have slots 710, 810, respectively, formed in them to receive a pin 114. FIGS. 5 and 6 show pin 114 in the operating position. FIG. 2 shows pin 114 removed from hinge body 110 to illustrate how slots 710, 810 engage pin 114. In this example, pin 114 includes a roller 116 that rotates around a center portion of pin 114 that is attached to hinge body 110 in order to provide a smooth rolling relationship between slots 710, 810 and pin 114.

The damping forces in conjunction with the curved shape of slots 710, 810 subject the hinge assembly to different forces at different points of travel of pin 114 through slots 710, 810. Applicant discovered that these differing forces require a very secure and stable mounting system for the connection between the hinge body and the door. This secure and stable mounting system is more important in order to ensure the smooth operation of a damped hinge assembly than a non-damped hinge because of these differing forces.

Figure 3:
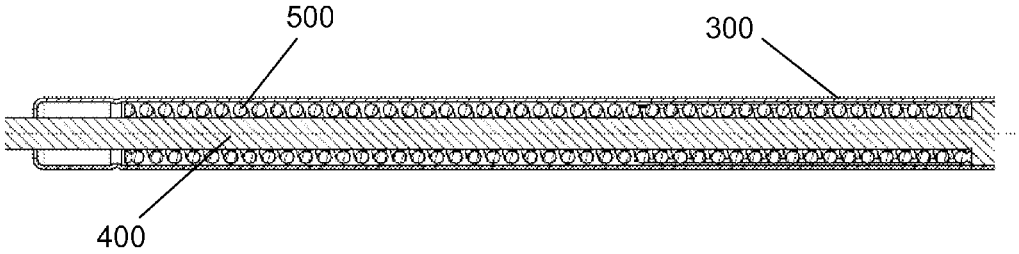
FIG. 3 is a sectional view of a damper in accordance with exemplary embodiments of the invention.

Embodiments of the invention include a coil spring positioned inside cylinder 300 as shown in FIG. 3. FIG. 3 shows rod 400 extending through the center of spring 500 and including a shoulder that supports the right side end of spring 500. As rod 400 is moved to the left in the figure, spring 500 is compressed. This movement corresponds to door 30 being moved from the closed position to the open position. As rod 400 is moved farther to the left, spring 500 becomes increasingly more compressed.

Figure 4:
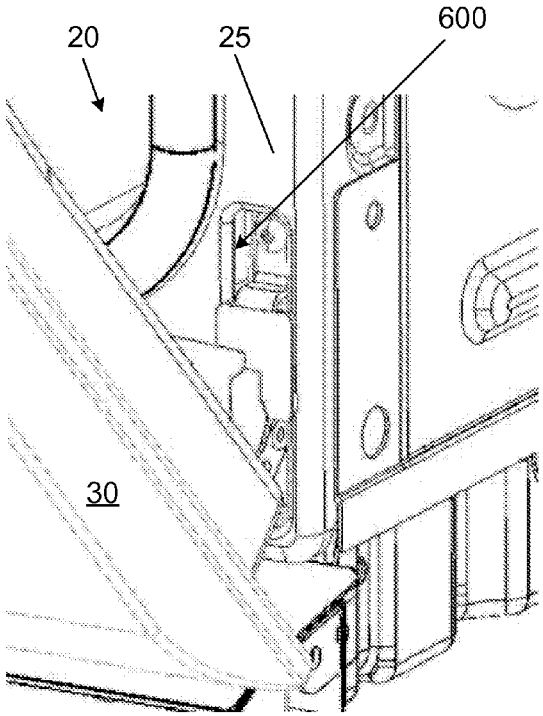
FIG. 4 is a perspective view of a domestic appliance in accordance with embodiments of the invention.

FIG. 4 shows door 30 attached to body 25 of domestic appliance 20, and in a partially opened position. Engagement end 124 of foot 120 is engaged with foot receiving portion 600 to keep door 30 attached to body 25.

FIGS. 5 and 6 show two different applications of embodiments of the invention.

FIG. 5 shows hinge assembly 100 with only one mounting spacer (mounting spacer 1000). The configuration of FIG. 5 can be used for a door 30 that has hinge assembly attachment areas that are not on the same plane. For example, door 30 can have one attachment area that aligns with mounting spacer 1000 and a second attachment area that aligns with mounting area 170. Mounting area 170 is shown with two mounting holes 172. Mounting holes 172 can be threaded to receive a threaded fastener, a rivet, or other fastener, or can be unthreaded to receive a rivet or other fastener. In this example, hinge body 110 also has two mounting holes 172 positioned below mounting spacer 1000 (not visible in FIG. 5) for mounting mounting spacer 1000 to hinge body 110. Although two mounting holes 172 are provided at each location in this example, other numbers of holes can be provided.

FIG. 6 shows assembly 100 with two mounting spacers (mounting spacers 900, 1000). The configuration of FIG. 6 can be used for a door 30 that has hinge assembly attachment areas that are on one plane that aligns with both mounting spacer 900 and mounting spacer 1000. In this case, both mounting spacers are attached to hinge body 110 by fasteners in mounting holes 172.

Applicant notes that the invention allows for the easy substitution of different mounting spacers for different applications. For example, different mounting spacers can have different thread sizes, no threads, a different number of holes, different heights, different over all shapes, etc. By allowing the easy substitution of different mounting spacers, solutions for different applications (including future, yet unknown applications) can be provided without having to manufacture a different hinge body for every different application.

Applicant also notes that in domestic appliances that have two hinge assemblies, particularly when the hinge assemblies are located or different sides of a door opening, slightly different spring characteristics, slightly different damper characteristics, and/or uneven wear of the spring, damper, or other components, can cause the hinge assemblies to operate with different force and damping characteristics. Such differences can result unequal forces acting on the door of the domestic appliance. These unequal forces can act to twist or skew the door relative to the appliance body. The mounting system of the invention resists these forces as well as the damper/spring forces discussed above.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A hinge assembly for pivotably attaching a door to a domestic appliance having an appliance body, the hinge assembly comprising:

a hinge body having two mounting areas;

a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of at least a portion of the coil spring, the damper damping the movement of the rod relative to the cylinder, and the rod extending along the central longitudinal axis of the damper; and a foot pivotably attached to the damper, the foot being configured to engage a foot receiving portion of the appliance body such that the hinge body and the door pivot relative to the appliance body, wherein each of the two mounting areas is configured to receive a first fastener to attach a mounting spacer to the hinge body, at least a first one of the mounting areas has a mounting spacer attached thereto, the mounting spacer being configured to attach to the door such that the hinge body is fixed relative to the door, and each of the two mounting areas is configured to receive a second fastener to attach the door to the hinge body.

2. The assembly of claim 1, further comprising a second mounting spacer attached to the hinge body at the second one of the mounting areas, the second mounting spacer being configured to attach to the door such that the hinge body is fixed relative to the door.

3. The assembly of claim 2, wherein each of the two mounting areas has a mounting hole, the mounting hole being configured to alternatively receive the first fastener and the second fastener.

4. The assembly of claim 3, wherein the foot is pivotably attached to the damper by a linkage that is pivotably attached to the damper and pivotably attached to the foot.

5. The assembly of claim 1, wherein each of the two mounting areas has a mounting hole, the mounting hole being configured to alternatively receive the first fastener and the second fastener.

6. The assembly of claim 1, wherein the foot is pivotably attached to the damper by a linkage that is pivotably attached to the damper and pivotably attached to the foot.

7. The assembly of claim 1, wherein each of the two mounting areas has a mounting surface located on a common mounting area plane, the mounting spacer has a door-attachment surface that is non-coplanar with the mounting area plane, and the hinge assembly is configured to attach to the door with the mounting spacer attached to the first one of the mounting areas and no mounting spacer attached to a second one of the mounting areas.

8. A door assembly for pivotably attaching to a domestic appliance having an appliance body, the door assembly comprising:

a door; and a hinge assembly, the hinge assembly having a hinge body having two mounting areas;

a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of at least a portion of the coil spring, the damper damping the movement of the rod relative to the cylinder, and the rod extending along the central longitudinal axis of the damper; and a foot pivotably attached to the damper, the foot being configured to engage a foot receiving portion of the appliance body such that the hinge body and the door pivot relative to the appliance body, wherein each of the two mounting areas is configured to receive a first fastener to attach a mounting spacer to the hinge body, at least a first one of the mounting areas has a mounting spacer attached thereto, the mounting spacer being attached to the door such that the hinge body is fixed relative to the door, and each of the two mounting areas is configured to receive a second fastener to attach the door to the hinge body.

9. The assembly of claim 8, further comprising a second mounting spacer attached to the hinge body at the second one of the mounting areas, the second mounting spacer being attached to the door such that the hinge body is fixed relative to the door.

10. The assembly of claim 9, wherein each of the two mounting areas has a mounting hole, the mounting hole being configured to alternatively receive the first fastener and the second fastener.

11. The assembly of claim 10, wherein the foot is pivotably attached to the damper by a linkage that is pivotably attached to the damper and pivotably attached to the foot.

12. The assembly of claim 8, wherein each of the two mounting areas has a mounting hole, the mounting hole being configured to alternatively receive the first fastener and the second fastener.

13. The assembly of claim 8, wherein the foot is pivotably attached to the damper by a linkage that is pivotably attached to the damper and pivotably attached to the foot.

14. The assembly of claim 8, wherein each of the two mounting areas has a mounting surface located on a common mounting area plane, the mounting spacer has a door-attachment surface that is non-coplanar with the mounting area plane, and the hinge assembly is configured to attach to the door with the mounting spacer attached to the first one of the mounting areas and no mounting spacer attached to a second one of the mounting areas.

15. A domestic appliance, comprising:

an appliance body having a foot receiving portion;

a door; and a hinge assembly, the hinge assembly having a hinge body having two mounting areas; a damper having a central longitudinal axis and including a damper cylinder attached to the hinge body, the damper cylinder having a rod partially located inside the cylinder and partially located outside the cylinder, and a coil spring located inside the cylinder and around the rod such that the rod extends through a center of at least a portion of the coil spring, the damper damping the movement of the rod relative to the cylinder, and the rod extending along the central longitudinal axis of the damper; and a foot pivotably attached to the damper, the foot engaging the foot receiving portion of the appliance body such that the hinge body and the door pivot relative to the appliance body, wherein each of the two mounting areas is configured to receive a first fastener to attach a mounting spacer to the hinge body, at least a first one of the mounting areas has a mounting spacer attached thereto, the mounting spacer being attached to the door such that the hinge body is fixed relative to the door, and each of the two mounting areas is configured to receive a second fastener to attach the door to the hinge body.

16. The domestic appliance of claim 15, further comprising a second mounting spacer attached to the hinge body at the second one of the mounting areas, the second mounting spacer being attached to the door such that the hinge body is fixed relative to the door.

17. The domestic appliance of claim 16, wherein each of the two mounting areas has a mounting hole, the mounting hole being configured to alternatively receive the first fastener and the second fastener.

18. The domestic appliance of claim 17, wherein the foot is pivotably attached to the damper by a linkage that is pivotably attached to the damper and pivotably attached to the foot.

19. The domestic appliance of claim 15, wherein each of the two mounting areas has a mounting hole, the mounting hole being configured to alternatively receive the first fastener and the second fastener.

20. The domestic appliance of claim 15, wherein the foot is pivotably attached to the damper by a linkage that is pivotably attached to the damper and pivotably attached to the foot.

21. The domestic appliance of claim 15, wherein each of the two mounting areas has a mounting surface located on a common mounting area plane, the mounting spacer has a door-attachment surface that is non-coplanar with the mounting area plane, and the hinge assembly is configured to attach to the door with the mounting spacer attached to the first one of the mounting areas and no mounting spacer attached to a second one of the mounting areas.

* * * * *